United States Patent [19]

Nickipuck

[11] Patent Number: 5,042,332

[45] Date of Patent: Aug. 27, 1991

[54] ANGULARLY DISPLACED PIN COUPLING

[75] Inventor: Michael F. Nickipuck, Brookfield, Ill.

[73] Assignee: Qualicorp, Ltd., Westmont, Ill.

[21] Appl. No.: 442,064

[22] Filed: Nov. 28, 1989

Related U.S. Application Data

[63] Continuation-in-part of Ser. No. 235,287, Aug. 23, 1988, Pat. No. 4,938,107.

[51] Int. Cl.[5] ..... B25B 23/16

[52] U.S. Cl. ..... 81/177.8; 81/177.85; 403/379

[58] Field of Search ..... 81/177.1, 177.2, 177.4, 81/177.5, 177.7, 177.8, 177.85, 177.9, 124.4, 63.2, 439; 279/2 R, 75, 76; 403/365, 367, 361, 378, 379, 324

[56] References Cited

U.S. PATENT DOCUMENTS 1,982,008 11/1934 Mandl et al. ..... 81/177.85

4,938,107 7/1990 Nickipuck ..... 81/177.85

*Primary Examiner*—M. Rachuba

*Attorney, Agent, or Firm*—David C. Brezina

[57] ABSTRACT

A coupling for interconnected members uses a pin positioned in holes perpendicular to the axes of the members, where the holes in each are formed and arranged by angular displacement so that the pin rotationally forces the members against one another for an interference fit.

12 Claims, 1 Drawing Sheet

ANGULARLY DISPLACED PIN COUPLING

BACKGROUND OF THE INVENTION

This is a continuation in part of my U.S. Pat. No. 4,938,107 issued July 3, 1990 entitled "Wedge Locking Socket Device" which is incorporated by reference herein. In summary my tools are designed to provided advantages of ease of operation, increased utility, ease of maintenance and better value for products used in the typical environment of the mechanic, particularly the automotive mechanic.

Earlier embodiments of my inventions involved in part arrangements which could be utilized to effectuate the locking of a drive socket to my tool and the release of that socket for removal or replacement. The "Wedge Locking Socket Device" incorporates improvements in function and economy of production through the camming engagement of a series of retainer balls and a novel wedging control bar to provide wedging between the bar and balls for effectively locking an associated socket and includes a securement portion as a separate structure from an extension shank. The advantage in the use of a wedging control bar is that the forces contributing to retention are increased under load.

Advantages of separate securement portion or stub body include greater choices in manufacturing operations and materials, and economies in the aftermarket as where either the securement portion or shank requires repair or replacement. This latter embodiment has been further improved by the use of angularly displaced offset hole in the driving and driven portion and a lateral wedging relation with a pin extended therethrough as will be further discussed in this application to include advantages in the fit between the components, the precision obtainable in operation, the "feel" to the user and improvements in manufacture.

DETAILED DESCRIPTION OF THE PREFERRED EMBODIMENT

Figure 1:
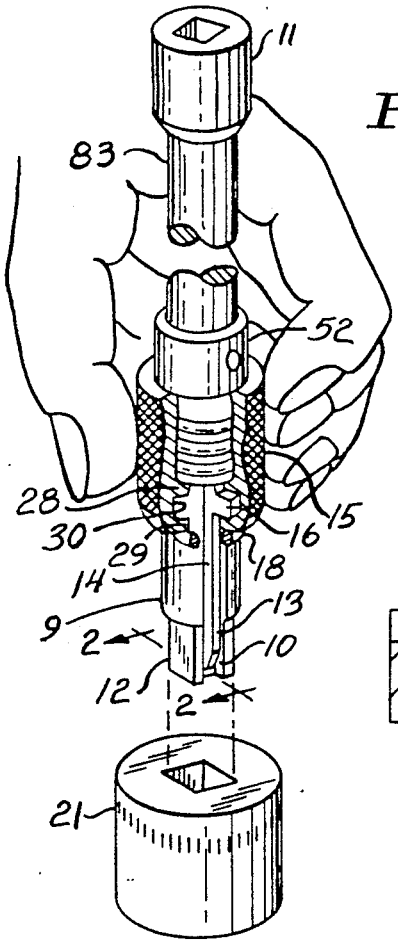
FIG. 1 is a perspective cut away view of my socket locking extension.

FIG. 1 illustrates a socket locking extension with a driven portion (11) extension shank (9) and square or multi-sided driving portion (12). The driving portion (12) fits into a complementary socket (21) for imparting rotational movement. A slot or channel (10) is formed in the surface of the shank and extends into one face or wall of the drive portion (11).

A control bar (14) which has an outer surface (13) is carried in a control bar channel. A raised portion or spur (16) extends outward from the outer surface (13) and fits into sleeve (15). The sleeve has internal annular engagement elements or flanges. In this embodiment these constitute an inner annular ring (28) and terminal annular ring (29) of the sleeve defining an annular groove (30) between them. This preferred embodiment does not foreclose the use of other methods of engagement. The forward motion of the sleeve toward the driving end is limited by a circular clip (18) as in prior embodiments. Rearward movement, limited by a limiting collar (52) which engages the rear edge of the sleeve. This collar may be formed as a raised ring portion of the shank material and enables the engagement of a second shank (83) as will be more fully described. In the preferred embodiment the sleeve may be covered with a friction increasing surface pattern such as knurling or other arrangements making the sleeve easy to grip and retract.

Figure 2:
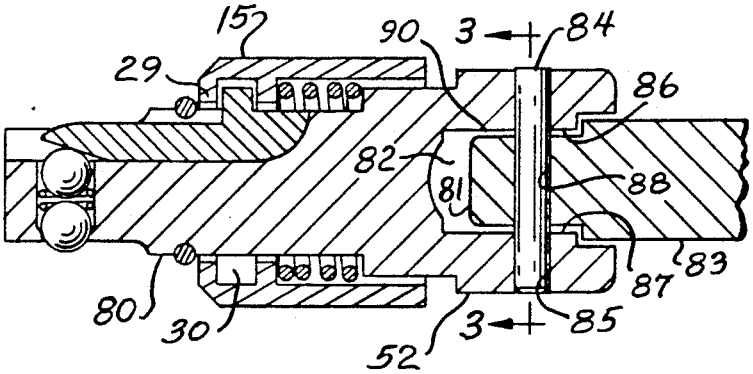
FIG. 2 is a sectional view of an embodiment in which a separate securement structure is attached to a drive shank.

FIG. 2 shows the securement portion of the tool carried on a truncated body (80) of length sufficient to carry the sleeve (15), provide for the stop portion or collar (52) limiting retraction of the sleeve and is adapted to receive the driving end (81) of a second shank (83) in corresponding recess (82) in the truncated body. Operation of the retainer mechanism carried on the truncated body is unchanged from the embodiments discussed in connection with my co-pending application. The recess for driving the truncated body by the second shank (83) is defined by walls that correspond to the driving portion (81) of the second shank (83). Shanks (9) and (83) are coaxial.

The truncated body (80) is attached to the second shank (83) in a semi-permanent manner through the insertion of a pin (84) in a hole or aperture (85) extending through one wall (86) of the truncated body's recess, through a corresponding hole or aperture (88) in the driving portion (81) of the second shank (83) and through the opposing wall (87) of the driven recess of the truncated body. This pin may be inserted and maintained in place by a compression fit thereby resulting in a unitary extension tool.

The use of the arrangement in FIG. 2 permits the use of dissimilar alloy metals in the truncated body and second shank, the use of differential treatment as by heat treating of the respective truncated body and second shank and repair or replacement of either the truncated body or the second shank without requiring replacement of both. A further advantage is that production can be streamlined because of the previous mentioned material and heat treatment flexibility. Related to this is the possibility of using closer tolerance on the truncated body while the second shank only needs such close tolerance where it connects to the truncated body. Further, the truncated body-second shank arrangement permits adaptation of various length extensions which may be more easily conformed to specific consumer needs. The space (90) between the wall (86) of the truncated body and the walls (86) and (87) which form the driving end (81) of the second shank are required by manufacturing tolerances, and are exaggerated here for illustration.

Figure 3:
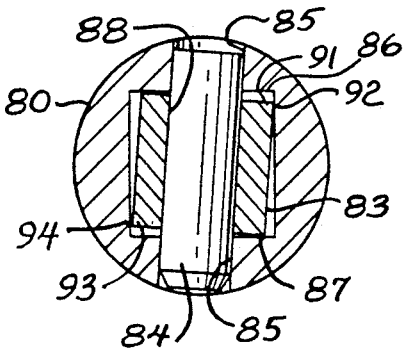
FIG. 3 is a sectional view of the angularly offset coupling taken at a transverse line 3—3.

FIG. 3. is a sectional view showing the interrelation between the male end of the second shank (83) and the recess of the body or first shank (80). It has been determined that at normal manufacturing tolerances, to permit the longitudinal insertion of the second shank into the recess, using parallel holes in the respective walls and driving portion, and using various pin configurations, an unacceptable degree of "play" is present. Disadvantages the prior art configurations include: inaccuracy in application of calibrated torque, added stress on the pin through repeated cycling of load and no-load conditions, and generally the presence of lost motion in taking up the tolerances in operation. Pressing the pin

(84) in place with hole or aperture (85) and hole or aperture (88) angularly offset pre-loads the assembly, forming an interference fit shown where corners (91), (92) and (93), (94) contact. All outside corners of shank (83) contact the walls of recess (82) near the respective inside corners.

Figure 4:
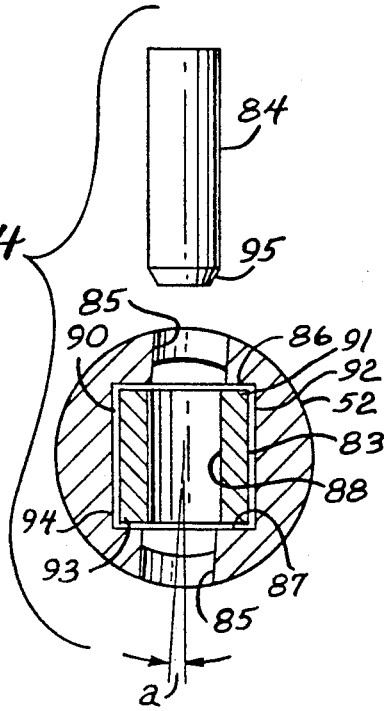
FIG. 4 is a sectional view of the angularly offset pin coupling corresponding to FIG. 3 with a rolled pin disengaged.

FIG. 4 shows the first and second shanks in their relative positions prior to pressing the pin (84) in place. The invention uses in the preferred embodiment, a rolled pin (84) which is chamfered at the insertion end (95). Since the truncated body is the element designed for higher precision manufacturing, the hole or aperture (85) through the walls is angularly offset by rotating in a clockwise direction. An interference fit will result when the pin is pressed in place. It has been found that optimum rotation or angular offset (a) should be determined to take up all space or clearance provided for by the maximum range of tolerances specified, and therefor closer tolerances will simply result in a superior fit at slightly greater pre-load. For a typical ⅜" drive standard tool, a 2° rotation is preferred.

The rolled pin in particular, has sufficient elasticity or flexibility and strength to both impart the pre-load when pressed in, yet will permit counterclockwise rotation with little adverse effect, the pin either bearing the torque itself, or distorting sufficiently to permit the bearing or contact at outside/inside corner pairs (91), (92), and (93), (94) of the respective walls on one another. A pin of different configuration, such as a solid pin, can perform the function without departing from the invention, providing equivalent performance.

The chamfer on the pin end (95) provides for a finished end, and includes centering properties enabling greater ease in the placement and pressing of the pin, and the imparting of the rotation of the second shank within the recess without back lash for greater efficacy. Notwithstanding the preferred embodiment, other pins end shapes, such as a radiused end, or a taper, may perform the function without departing from the invention.

In driving the pin through the offset apertures (88), (85) in the shank (83) and the truncated body portion (52) the pin or the tool parts, depending upon their metallurgy, will slightly deform and provide a tight interlock of these parts with each other at the contacting surfaces 91-94 as shown in FIG. 3.

In accordance with my invention I claim:

1. For use with a socket member having a wall defined securement opening, a securement structure comprising:

a first shank member adapted to extend within said securement opening and having a perimetrical surface;

a control bar supported on said first shank member adjacent to the perimetrical surface;

said first shank member having longitudinal guide means extending through said surface;

said control bar in said guide means being slidable with respect to said first shank;

retention means holding the control bar on the first shank and permitting longitudinal and limited radial movement of the control bar with respect to the first shank member;

detent means supported on the first shank member and extendible through said surface for selective movement between a locked and release position;

said detent means extending in the locked position to engage one of two opposing walls of said socket member, thereby securing the socket member on the first shank;

said detent means in the release position being withdrawn from said engagement to permit removal of the socket member from said first shank;

said control bar having wedging means wedging with the detent means and moving said detent means into said locked position when the control bar is moved into the locked position;

said wedging means being cooperative with said detent means beyond the limit of movement of said bar to locked position;

said detent means compressing two retainer balls reactively disposed between said bar and an opposing socket wall;

said first shank member having a driven end with walls defining a recess adapted to receive a driving element;

said first shank member having front and rear ends, and carrying first and second motion limiting means and sleeve means;

said control bar being movable longitudinally with forward motion limited by said first motion limiting means and rearward motion limited by said second motion limiting means;

said control bar being movable radially with radially outward movement limited by said sleeve means and radially inward movement limited by a recessed surface in said first shank member;

said driving element comprising a second shank member with driving means corresponding to said driven end of said first shank member;

said second shank member being attached to said first shank member;

said first and second shank members being attached by a pin extending through respective adjoining walls and said pin imparting a rotational pre-load on said shank members in one direction of rotation.

2. A connection of first and second members having a common longitudinal axis and corresponding power transmitting contacting surfaces for transmitting rotation between said surfaces;

the first member having a recess encompassed by walls laterally terminating in said surfaces and the second member having a projecting portion having corresponding surfaces, the respective surfaces being separated by sufficient clearance to permit, during assembly, insertion of the projecting portion into the recess;

means for connecting the first and second members connecting recess and projecting portion for preventing disconnecting of the members and transmitting torque between said members through an interference fit between the respective surfaces of said first and second members, by at least partially closing said clearance in one direction of relative rotation between the members, about their common longitudinal axis.

3. The invention according to claim 2, and said means for connecting said members further comprising a pin extending through said members.

4. The invention according to claim 3, and said means for connecting said members further comprising a first aperture extending generally perpendicularly to the axis of the members when viewed from the side, extending through the recess in the first member, and a second aperture extending generally perpendicularly to the axis of the members through the projecting portion of the second member, said apertures being angularly offset relative to one another and said interference fit being induced by the engagement of said pin in the apertures.

5. The invention according to claim 4, and said pin comprising a rolled pin extending completely through the recessed and connecting portions of the respective members.

6. The invention according to claim 5, and said members further comprising one of: a pair of shanks, a shank and a tool, and a shank and means for rotating the shank.

7. A drive transmitting connection between telescoped driving and driven members having a common longitudinal axis, a first diametrical aperture in said driving member, a second diametrical aperture in the driven members slightly angularly offset from the first aperture by rotation around the longitudinal axis, and means for holding said members positioning the apertures in the respective members angularly offset from each other around said longitudinal axis and providing a drive transmitting route between said members.

8. The invention according to claim 7 and said apertures and means for holding said members further placing said telescoping members in an interference fit by said rotation around the longitudinal to enable said drive transmitting to effectively transmit torque around the axis.

9. The invention according to claim 8 and said holding means comprising a pin complementarily fitting with said apertures.

10. The invention according to claim 9 and said pin resiliently maintaining said members position and said rotational interference fit therebetween.

11. A coupling for transmitting rotary motion comprising a driven shank having first and second ends with a longitudinal axis therebetween;

a recessed portion on one of said ends;

a second shank with a driving end, being adapted to engage said recess on said first shank and a driven end with a longitudinal axis therebetween, the axis of the second shank being coaxial with the axis of the first shank;

means for coupling said engaged shanks together longitudinally maintaining the engagement therebetween;

means for preloading said coupling means between the shanks in a torsional manner around the longitudinal axis of the shanks for reducing the shock loads as a rotational force is applied to one of said shanks.

12. The invention according to claim 11, and said coupling means further comprising;

said recess having a plurality of spaced walls parallel to the longitudinal axis of the shank;

said second shank engaging said recess through the mating of said driving end;

said driving end having a corresponding series of walls;

said coupling means being a pin extending through said plurality of walls in the recess and a corresponding plurality of walls in said driving end of the second shank;

said torsional preload means being an offset engagement of said pin by said shanks relative to one another so that the placement of said pin in said respective walls rotationally moves a portion of said corresponding walls into engagement with one another whereby an interference fit is provided.

* * * * *